US009551158B1

(12) United States Patent
Leines

(10) Patent No.: US 9,551,158 B1
(45) **Date of Patent: *Jan. 24, 2017**

(54) DUAL FITTING PLANK AND CLIP SYSTEM

(71) Applicant: Richard A. Leines, Wellington, VA (US)

(72) Inventor: Richard A. Leines, Wellington, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/878,291

(22) Filed: Oct. 8, 2015

Related U.S. Application Data

(62) Division of application No. 13/998,042, filed on Sep. 25, 2013, now Pat. No. 9,200,445.

(60) Provisional application No. 61/744,487, filed on Sep. 26, 2012.

(51) Int. Cl.

| | |
|---|---|
| ***E04B 5/00*** | (2006.01) |
| ***E04F 15/02*** | (2006.01) |
| ***E04F 15/10*** | (2006.01) |
| ***E04F 15/06*** | (2006.01) |
| ***E04F 15/04*** | (2006.01) |

(52) U.S. Cl.
CPC ..... *E04F 15/02038* (2013.01); *E04F 15/04* (2013.01); *E04F 15/06* (2013.01); *E04F 15/105* (2013.01)

(58) Field of Classification Search
CPC ..... E04F 15/02038; E04F 15/04; E04F 14/06; E04F 15/105
See application file for complete search history.

(56) References Cited

U.S. PATENT DOCUMENTS

| | | | | |
|---|---|---|---|---|
| 6,070,336 | A * | 6/2000 | Rodgers | E04G 21/1891 33/370 |
| 6,324,796 | B1 * | 12/2001 | Heath | E04B 5/026 52/177 |
| 6,594,961 | B2 * | 7/2003 | Leines | E01C 5/20 52/177 |
| 2009/0094925 | A1 * | 4/2009 | Andres | E04F 15/02 52/511 |
| 2011/0192112 | A1 * | 8/2011 | Pelc, Jr. | E04F 15/02 52/705 |

* cited by examiner

*Primary Examiner* — Patrick Maestri
(74) *Attorney, Agent, or Firm* — David Pressman

(57) ABSTRACT

A clip for attaching a deck plank to a surface, comprises an elongated strip having bottom and top opposing surfaces with a leg extending up from said top surface between its ends. The leg has at least one flange projecting out at a location spaced from the top surface. The flange has an underside facing the top surface for engaging and mating with a ledge of a deck plank. The mating deck plank readily attaches to the clip when force is applied generally from the upper surface down on the plank. The deck plank has a bottom recess with an internal ledge or ledges that mates with and snaps onto the flange or flanges of the clip.

18 Claims, 17 Drawing Sheets

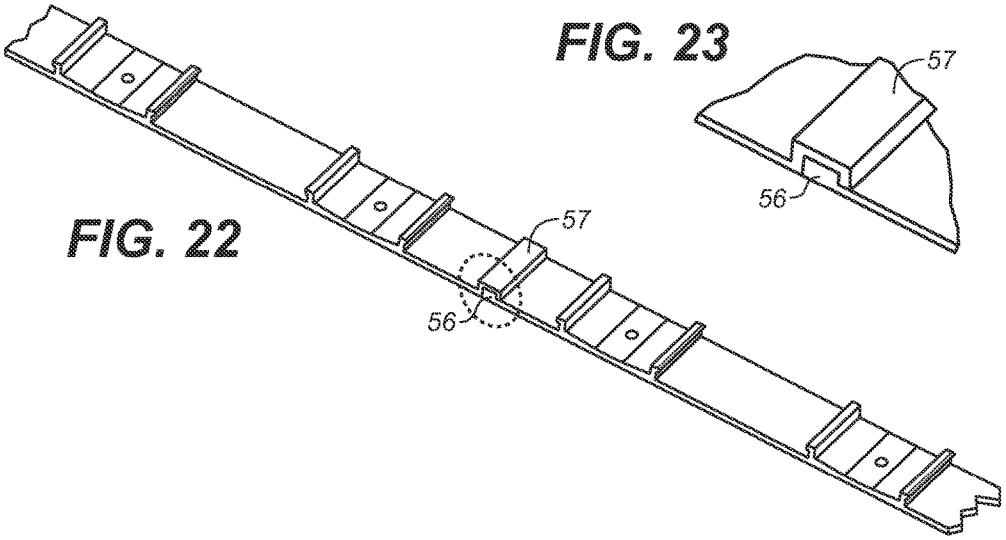
FIG. 22
FIG. 23
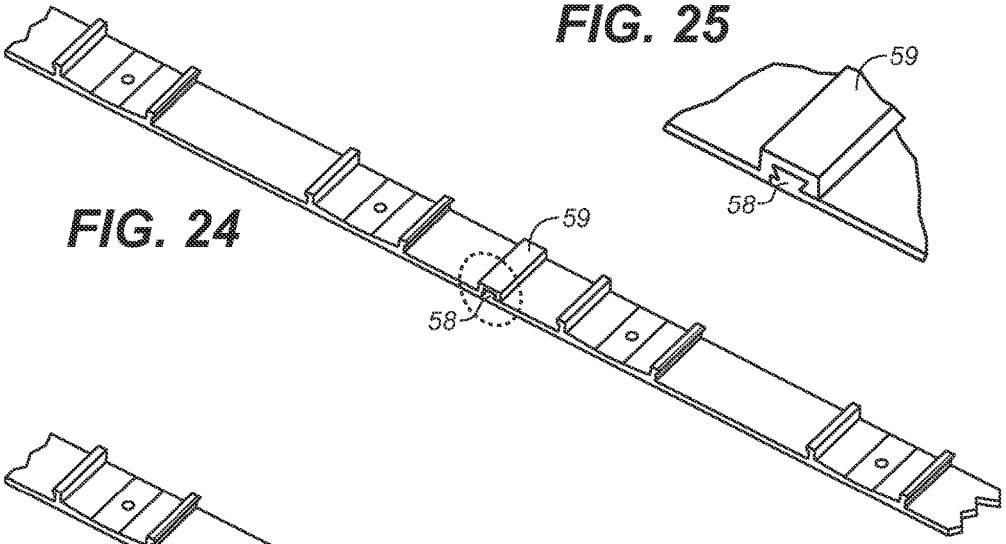
FIG. 24
FIG. 25
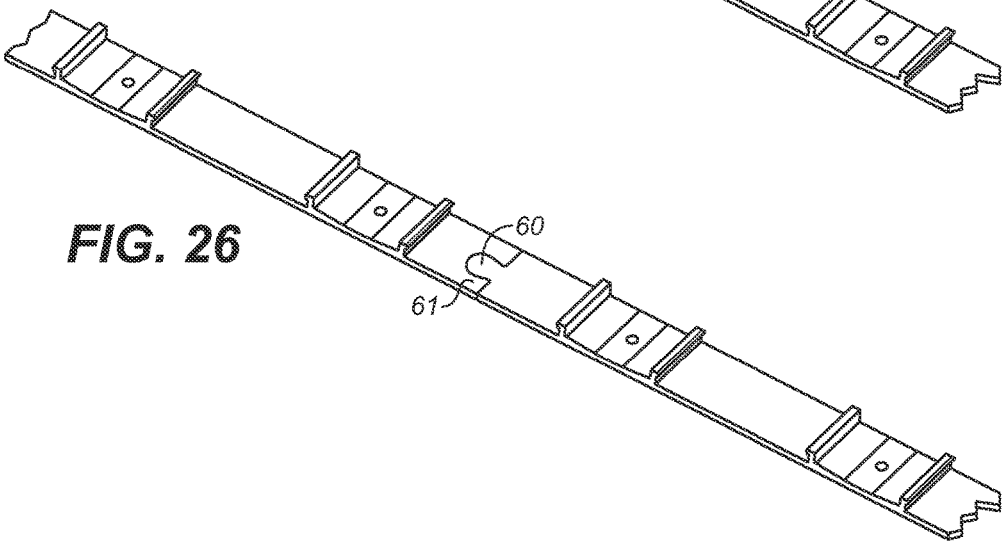
FIG. 26

FIG. 30
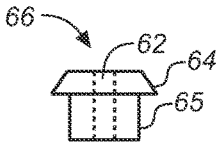
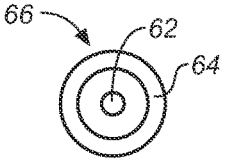
FIG. 31
FIG. 32
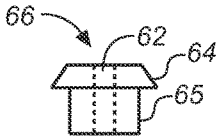
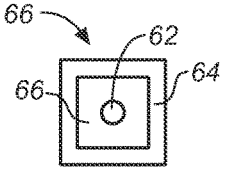
FIG. 33
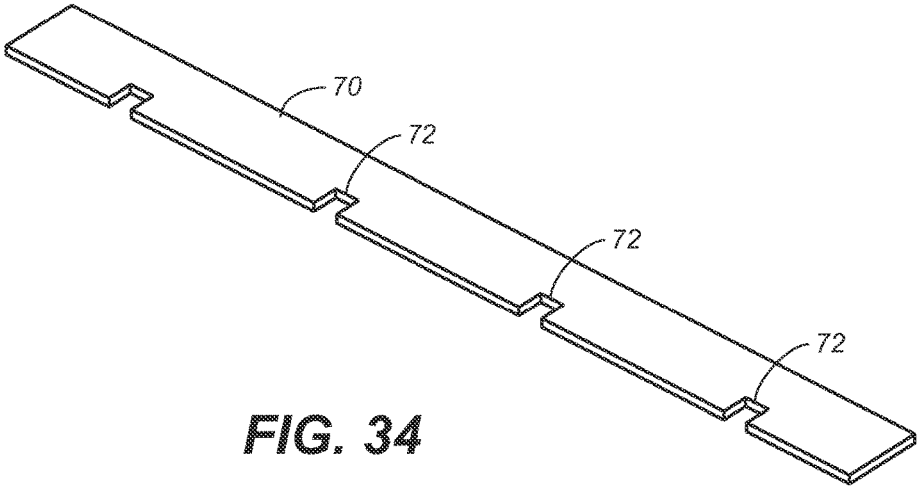
FIG. 34
FIG. 35
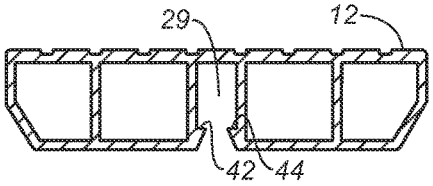

DUAL FITTING PLANK AND CLIP SYSTEM

CROSS-REFERENCE TO RELATED APPLICATIONS

This application is a division of parent application Ser. No. 13/998,042, Filed 2013 Sep. 25, now U.S. Pat. No. 9,200,445, Granted 2015 Dec. 1. This parent application claims the benefit of provisional patent application Ser. No. 61/744,487, filed 2012 Sep. 26 by the present inventor.

BACKGROUND

Prior Art

Usually a deck or boat dock is constructed of horizontal wood members (ledgers or putlogs) which support a finished surface layer, normally wood planks or boards (hereinafter planks). Such decks or docks (hereinafter decks) are exposed to the environment and thus tend to rot and decay. Even redwood and pressure-treated lumber often need regular annual maintenance that is costly as well as a nuisance. Often when the deck deteriorates the supporting structure or joists are also likely to deteriorate, requiring expensive repairs. Also the pressure-treated materials used in deck construction may react chemically with the fasteners, brackets, and other building materials.

Plastic extruded deck planks have been used, but these have disadvantages, such as an irritable squeaking sound when the planks are walked upon due to their rubbing together and the method of connection. With respect to the latter, plastic planks are very difficult to install properly without expert help, which adds tremendously to the cost of the residential homeowner's project. Existing plastic planks, composite, or metal materials also tend to expand and contract due to temperature. This is especially true in the lengthwise direction of the plank. This can be detrimental to any screws, anchors, or fastening means used to hold the planks in place. The expansion and contraction causes the material around the fastener or the like to wear or elongate, which causes the deck plank to loosen from the subassembly.

Extruded polyvinyl building materials are increasing in popularity due to their light weight, which simplifies shipping, handling, and installation. Extruded polyvinyl materials do not need to be periodically painted or preserved, which lowers maintenance costs. Modern ultra-violet (UV) inhibitors prevent the breakdown of polyvinyl materials for many years. A well thought out product can overcome the many challenges the environment presents.

The following is tabulation of some prior art that presently appears relevant:

U.S. Utility Patents

| Patent or Pub. Nr. | Kind Code | Issue or Pub. Date | Patentee or Applicant |
|---|---|---|---|
| 5,009,045 | B1 | 1991 Apr. 23 | Yoder |
| 5,950,377 | B1 | 1999 Sep. 14 | Yoder |
| 5,642,592 | B1 | 1997 Jul. 1 | Andres |
| 6,112,479 | B1 | 2000 Sep. 5 | Andres |
| 6,739,106 | B2 | 2004 May 25 | Curatolo |
| 5,758,467 | B1 | 1998 Jun. 2 | Snear |
| 6,324,796 | B1 | 2001 Dec. 4 | Heath |
| 7,047,697 | B1 | 2006 May 23 | Heath |

Yoder '045 (1991) shows a clip strip used to attach the deck plank to the floor assembly. The labor and skill needed to engage the plank to the clip correctly is so great that professional help is often needed for proper installation. Once engaged, the deck plank is difficult to disengage (e.g., for remodeling) without damage to plank or clip. Also the plank is not able to span existing joist or substructure spacing easily when replacing a deck surface.

Yoder '377 (1996) shows a clip strip used to attach the deck plank to the floor assembly. Again, the labor and skill needed to engage the plank to the clip correctly is so great that professional help is often needed for proper installation. Once engaged, the deck plank is difficult to disengage (e.g., for remodeling) without damage. Also the plank is not able to span existing joist, or substructure spacing easily when replacing a deck surface.

Andres '592 (1997) shows an engagement strip that runs perpendicular to the supporting members in the same direction as the deck planks. These strips must be fully engaged along the full length of the plank. If this is not done, the plank will rub and make noise due to the lack of full engagement. The installation of these strips is also tedious and cumbersome and will have an unsightly appearance if due care is not taken upon installation.

Andres '479 (2000) shows a snap connector strip that runs generally perpendicular to the horizontal surface of wood joists in the same direction as the deck plank. These strips have an elongated base portion and must be fully engaged along the full length of the plank. If this is not done, the plank will rub and make noise due to lack of full engagement, an inherent disadvantage of this design. The installation of these strips is also tedious and cumbersome and will have an unsightly appearance if due care is not taken during installation. This strip system is not conducive to placement over flat surfaces due to the inability of the strips to fully engage themselves; thus noise is created from the plank and strip rubbing together.

Curatolo shows a deck plank with waterproof features. FIG. 2 shows joists running in the same direction as the deck planks, but one skilled in the art would not frame them this way. The fasteners are shown to be attached at a 45° angle through the 1.5-inch wide joist material. This attachment method as shown would be inadequate structurally as well as cost-prohibitive due to the amount of lumber needed for that deck as described. To remodel or repair a plank in a middle section of a deck, the repair would need to remove all the planks from one direction up to the area to be repaired. This would cost the homeowner a great deal of money for such a repair, which is often present in the construction industry. The direct fastening of the plank in this deck does not allow expansion and contraction. Thus the expansion and contraction will stress the fastener and the area around the fastener will elongate.

Snear discusses decks using clips which snap fit or have an interlocking fitting. This patent states that prior-art clip systems make noise such as squeaking and they do not allow expansion and contraction. Snear's deck design by does not allow expansion and contraction as each plank is directly screwed down at each joist. The fixed screw fastener, when subjected to hot and cold conditions, will expand and contract at the fastener locations. This will elongate the material around the screw fastener. This elongation of material will weaken the attachment of the deck planks. The screws in this deck are shown to be accessible to remove from the top surface. These fasteners are subject to the elements as water can remain in the trough area where fastened. Also during freezing temperatures the ice can expand the polyvinyl deck at these fasteners and reduce the hold-down capacity due to this unfavorable environment acting on the exposed fasteners.

Also the exposed fastener can corrode. All of these unfavorable attributes cause a reduction of function, especially to the fastener which must hold down the deck plank.

Heath '796 (2001) and '697 (2006) both disclose prior-art systems with mounting clips that have a number of drawbacks, including, relatively high material costs and relatively long installation time, and on such a system it is difficult to properly align the holes in the deck members with the preinstalled clips. Moreover, if the pre-installed clips are not mounted properly the decking members may move or wander giving the deck an unsightly and unprofessional appearance. Both patents show direct fastening of the deck to the substructure, but, as described before with such an attachment, the expansion and contraction at the screw fastener location will ultimately elongate the material around the fastener and weaken the connection. Also the design of the deck of both patents does not allow easy removal of a damaged deck plank, for instance. If the plank is damaged in the middle portion of the deck all the planks from the edge of the deck to the repair area will need to be removed to get to the damaged plank. There is no way to remove the damaged plank on its own and replace a new plank without noticeable exposed repair fasteners in the repaired deck, leaving an unprofessional looking repair.

Existing plastic extruded deck plank assemblies are labor intensive and require a great deal of skill to install. It is also difficult to assemble and/or lay them out uniformly. Most residential homeowners can neither install a plank assembly themselves if desired, nor repair and alter the deck themselves, but even if they use expert help to install or alter a deck, it is difficult to do this at a reasonable cost.

Advantages

Accordingly, several advantages of one or more aspects are as follows:

(a) An improved deck structure is provided.
(b) A deck plank can be engaged to its attachment device in a manner that does not require a great deal of skill or effort.
(c) The deck plank will engage easily, yet remain in place for its primary use.
(d) The deck plank can be assembled in a uniform manner, enabling ease of layout to those skilled or unskilled in the art.
(e) The deck plank can be disengaged readily with little effort, and repairs or replacement of individual planks can be done anywhere on the deck without removing multiple planks in the process.
(f) The deck plank and engagement clip will engage readily in such a manner as to allow the planks to expand and contract naturally and freely in the bounds of their assembly without damage, to the deck, clip, or fastener.
(g) The deck plank surface is substantially water resistant above the subassembly.
(h) The deck plank and engagement clip when assembled will not have audible squeaks when walked upon.
(i) The deck plank has hidden non-exposed fasteners.
(j) The deck plank system can be electrically grounded easily.
(k) A deck plank can span well over a subassembly.
(l) The deck and clip can be easily installation by the home owner.
(m) The deck plank is combined with a clip so unsightly fasteners are not seen after replacing damaged planks.
(n) The dual fitting plank and clip system does not require costly labor or intensive annual maintenance.
(o) The clip and plank can be made inexpensively with common known materials that are rot and insect resistant.
(p) The clip has can be manufactured more easily.

Further advantages of one or more aspects are the provision of a deck plank which has skid resistance and aesthetically pleasing qualities, which does not require costly or labor intensive annual maintenance, that is rot and insect resistant, and which can be installed by residential homeowners. Still further advantages of one or more aspects will become apparent from a consideration of the ensuing description and drawings.

SUMMARY

In accordance with one embodiment a deck plank is used with an engagement clip and can be attached thereto when force is applied generally from the upper surface down on the plank. First, a plurality of clips each including a flange leg and at least one flange is attached to an underlying surface. Secondly, a plurality of deck planks are oriented to the clip and urged into engagement, so that a secure deck structure is provided. The deck plank surface extends laterally beyond an outside vertical supporting panel and forms a downward facing supporting leg. The bottom portion extends laterally beyond outside vertical supporting panel and has formed there on an upwardly outside supporting leg. A water-resistant channel is thus formed between outside vertical support panel and the outside supporting leg. The deck plank and clip system allows individual repair of deck planks without removing the adjacent deck planks, while providing a water-resistant surface below the deck planks.

DRAWINGS

FIG. 22 is an isometric view of an alternative embodiment.

FIG. 23 is an enlarged partial view of FIG. 22.

FIG. 24 is an isometric view of an alternative embodiment.

FIG. 25 is an enlarged partial view of FIG. 24.

FIG. 26 is an isometric view of an alternative embodiment.

FIG. 30 is a side view of boss 66.

FIG. 31 is a top view of FIG. 30.

FIG. 32 is a side view of a boss 66 in a rectangular form.

FIG. 33 is a top view of FIG. 32.

FIG. 34 is an isometric view of a boss jig 70.

FIG. 35 is an end view of an alternative embodiment.

Reference Numerals

| | |
|---|---|
| 12 - Plank | 14 - Plank imprint |
| 15 - Symmetrical flange | 18 - Upper horizontal supporting member |
| 19 - Female inter-engagement ledge | 21 - Male inter-engagement flange |
| 23 - Male inter-engagement rib | 24 - Bottom horizontal supporting member |
| 25 - Female channel | 26 - Bottom horizontal supporting member |
| 28 - Intermediate integral vertical supporting panel | 29 - Elongated recess |
| 30 - Intermediate integral vertical supporting panel | 31 - Female elongated slot |
| 32 - Outside vertical supporting panel | 33 - Male elongated projection |
| 34 - Outside vertical supporting panel | 35 - Outside supporting leg |
| 36 - Oblique supporting panel | 37 - Elongated channel |
| 38 - Oblique supporting panel | 39 - Elongated channel |
| 40 - Horizontal stabilizing web | 41 - Removal tool |
| 42 - Engaging ledger | 43 - Socket slot |
| 44 - Engaging ledger | 45 - Downward facing supporting leg |
| 46 - Engaging clip | 47 - Grounding wire |
| 48 - Attachment screw | 49 - Structural supporting member |
| 50 - Inner mediate supporting web | 51 - Inner mediate supporting web |
| 52 - Retaining flange projection | 54 - Retaining flange projection |
| 55 - Flange supporting leg | 56 - First end FIG. 23 |
| 57 - Second end FIG. 23 | 58 - First end FIG. 25 |
| 59 - Second end FIG. 25 | 60 - First end FIG. 26 |
| 61 - Second end FIG. 26 | 62 - Attachment screw hole |
| 64 - Upper body flange | 65 - Lower body |
| 66 - Boss | 70 - Boss jig |
| 72 - Boss slot | |

DETAILED DESCRIPTION

FIGS. 1-5—Overall Arrangement

Figure 1A:
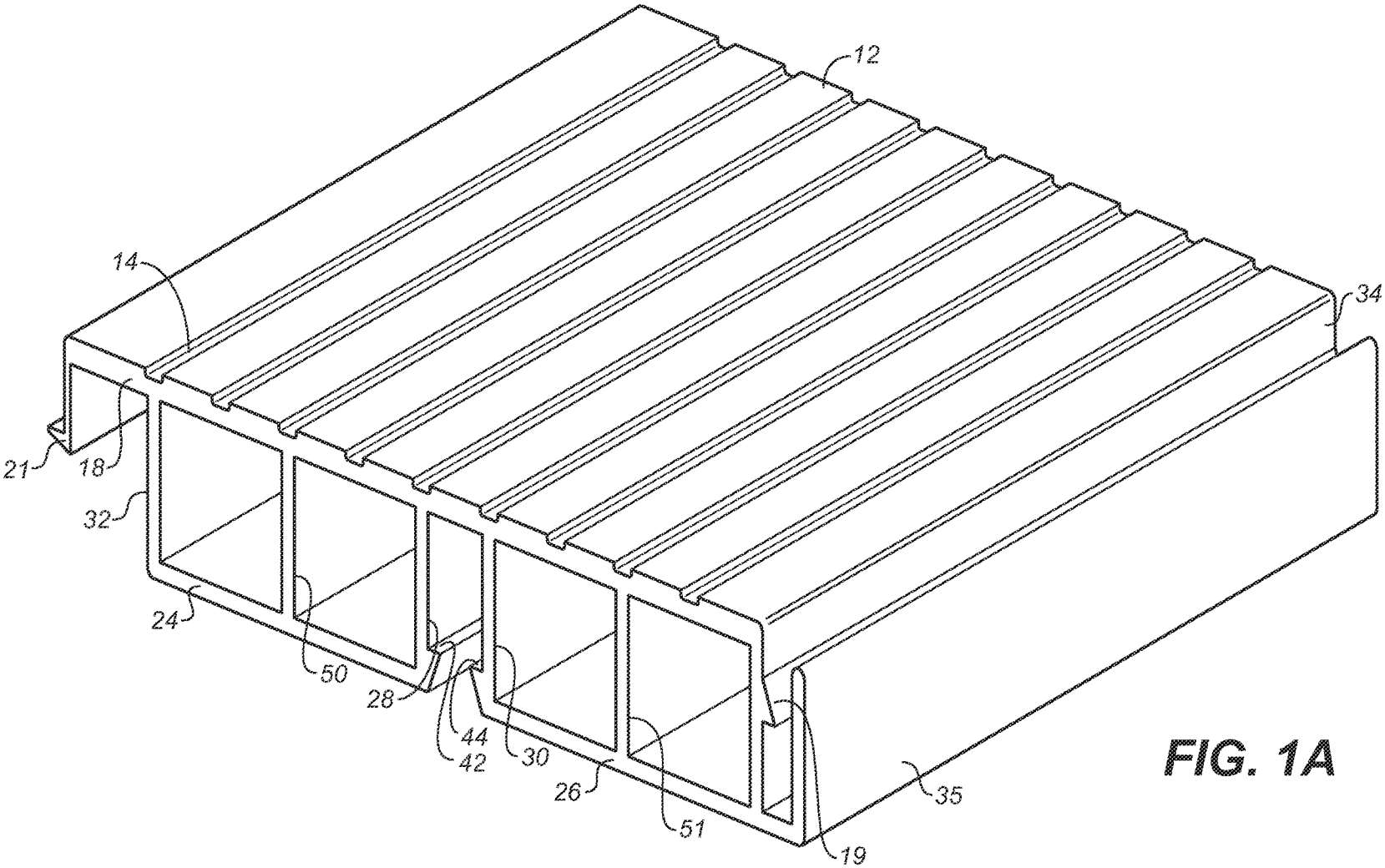
FIG. 1A is a partial perspective view of an extruded plastic deck plank.
Figure 2:
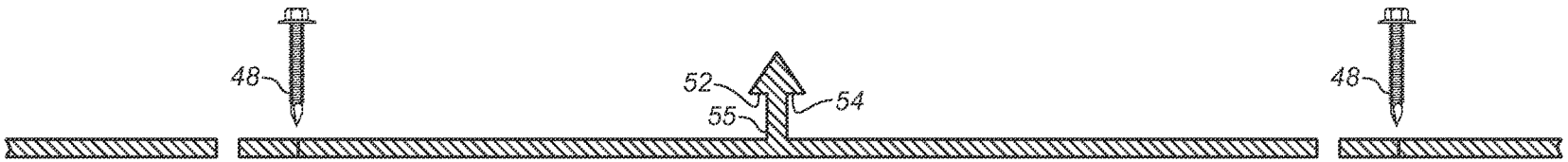
FIG. 2 is a side view of a clip.
Figure 5:
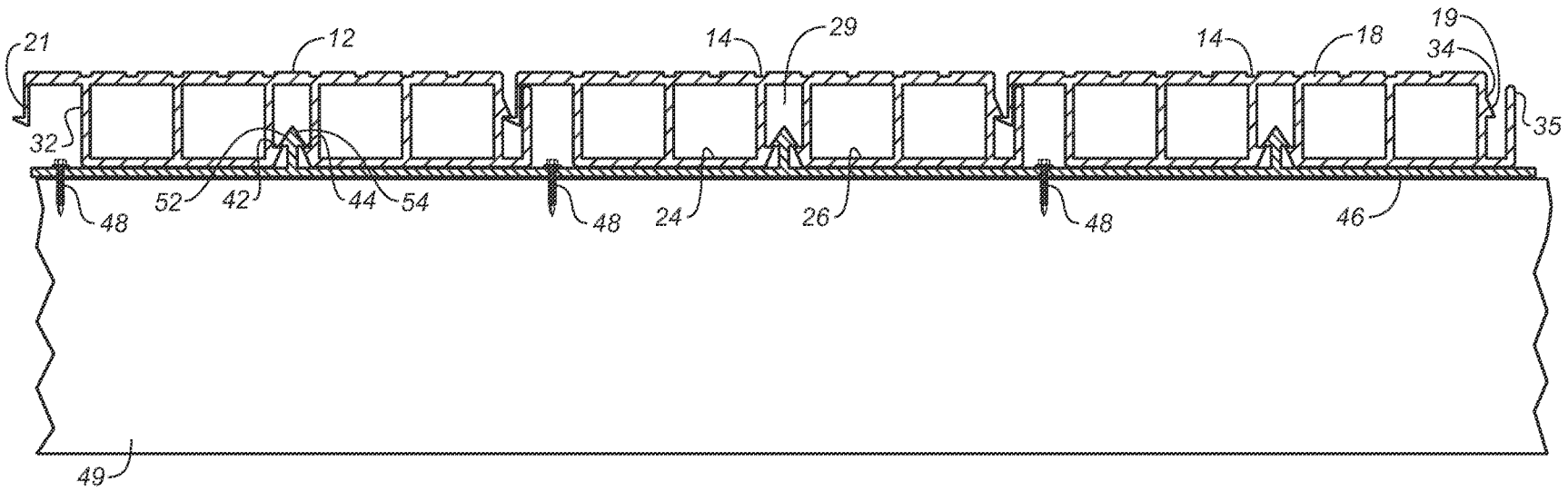
FIG. 5 is an end view of deck planks and engagement clips of FIG. 1A.

A first embodiment of a deck plank attachment system is illustrated in FIG. 1A (partial perspective view) and FIG. 5 (end view). The deck planks are mounted atop a floor assembly that consists of several horizontal-supporting stringers or joists, one of which is shown as joist 49 (FIGS. 5, 8, 10, 14, 16, 18, 19, and 28). The joists are spaced parallel to one another. Each joist supports a series of inter-engaging clips 46 (FIGS. 5, 8, 14, and 18), which extend along the top of each joist or subassembly. A series of deck planks 12 (FIGS. 5, 8, 14, and 18) are spaced above the joists and run generally perpendicular to the joists. As shown in FIG. 2 each plank is held to each joist by at least one clip, which includes a flat base and one leg 55 and a pair of flanges 52 and 54, which extend out from the top of the leg. As shown, leg 55 and its flanges is integral with the base so that, when the base it attached to the joist, the leg and its flanges cannot move or rotate. Each plank overlies a group of parallel joists. E.g., if a plank is 4.88 meters long and the joists are spaced on 40.6 cm centers, than each plank is supported by 13 joists.

Clips and Flanges—FIGS. 2, 3, 5, 28, 30, 31, 32, 33, and 34

In the first embodiment, clip 46 (FIG. 5) is preferably made of plastic. However, it can be made of any other suitable material, such as fiberglass, aluminum, composite, or metal. Deck plank 12 is preferably a plastic, such as polyvinyl chloride. However, it can be made of composite, fiberglass, aluminum, metal or even wood or wood inlaid with metal ledges. (Metal components are suitably protected against corrosion.)

Figure 3:
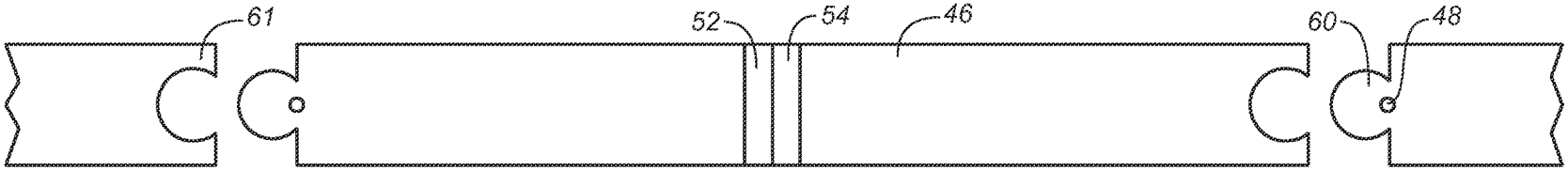
FIG. 3 is a top view of a clip.

The ends of each engagement clip 46 have puzzle-shaped or male-to-female interlocking ends as illustrated in FIG. 3. First end 60 is the male end or plug and second end 61 is the female end or recess. In one embodiment, plug 60 was spherical and had an outer diameter of approximately 20 mm and recess 61 was also spherical and had an entrance dimension of approximately 20.2 mm so that the plug could be snapped into the recess and the recess would hold the plug in place. Attachment screw 48 secures clip 46 to joist 49. Attachment screw 48 is shown with a washer head but can also be a flush mount screw if needed by design.

Figure 28:
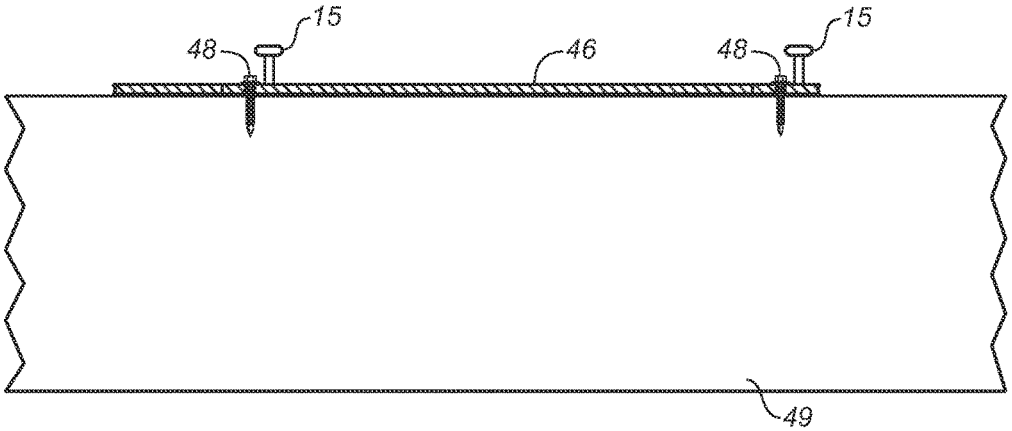
FIG. 28 is a side view of the engagement clips and attachment screws of FIG. 27.

The clip has one upright flange support leg 55 with respective flange projections 52 and 54 (FIGS. 2, 3, and 5) which extend out horizontally from the upper sides of the leg. The flanges are at a height that allows a connection to be made between engagement clip 46 and deck plank 12. As shown, the top surfaces of the flanges slope upwardly to each other to form an anticline or arrow-shaped head on leg 55. As shown in FIGS. 30, 31, 32, and 33, the head of leg 55 can have a flat top and the flange projections can be continuous around the upper portion of leg 55, forming a monolithic flange. The single flange leg and monolithic flange can be manufactured with a clip base as shown in FIG. 28.

The clip can be made where a flange leg 55 is mounted on clip 46 at an angle (Figure not shown). Injection molding allows for the clip to be manufactured at different angles. These differing angles will allow the deck planks to be placed at an angle other than perpendicular to the joist for a different aesthetic look.

If space on a deck project is restricted for various reasons such as obstacles or limited accessibility, a boss 66 (FIGS. 30, 31, 32, and 33) can be used in place of a clip 46 to attach the deck plank. Boss 66 is used to secure a portion of a deck plank at a joist in areas where a regular clip 46 would be difficult to install. Boss 66 has a lower body or leg 65 and an upper body or flange 64 that overhangs or is continuous about the lower body or leg by a given distance that allows the boss to mate with a deck plank. Boss 66 can be injection molded.

Figure 27:
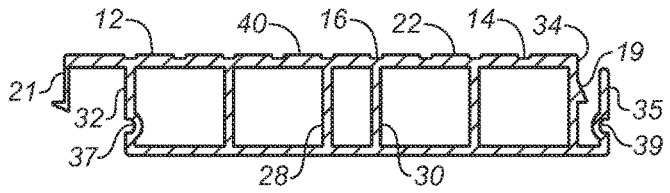
FIG. 27 is an end view of an alternative embodiment of a deck plank.

Preferably an attachment hole 62 (FIGS. 30, 31, 32, and 33) is located in the center of boss 66 and an attachment screw 48 (FIG. 28) is used to securely affix the boss to a supporting member 49. Boss 66 is placed on top of a surface for attachment. Boss 66 is located at a predetermined location on the surface and subsequent bosses 66 can also be attached at predetermined locations on the surface. Planks 12 can be placed over bosses 66 and will engage bosses 66 when a generally downward pressure is applied to planks 12. This is most easily accomplished when an installer steps on top of plank 12 starting from one end and walks down the length of plank 12. Boss 66 can be injected molded with a base which forms a track or clip with at least one boss on the base. This arrangement can be seen in FIG. 28 in which boss 66 has a symmetrical flange 15. If the plank of FIG. 27 is directed down toward FIG. 28, deck plank 12 will secure itself to clip 46 at the two symmetrical flanges 15. The snap down connection, and the ability of plank 12 of FIG. 27 to be removed from the symmetrical flanges 15 easily, shows this embodiment will operate similarly or equivalent to FIG. 1A. Elongated recess 29 FIG. 4, which contains engaging ledgers 42 and 44, is substituted with elongated channels 37 and 39 in this embodiment for securing plank 12 to clip 46. Another place for application, for example, would be at an angle, such as a 45° angle, where a regular clip 46 would not have the proper angle to easily attach with a deck plank 12. Boss 66 can be easily located at the angle portion of the substructure framing and attached with a screw. The bosses can be used for the complete deck and if a jig or template 70 (FIG. 34) is used it will assure by way of boss slot 72 a consistent spacing for bosses on all joists of the deck substructure. Boss 66 can be round or rectangular as shown in FIGS. 30, 31, 32, and 33.

Figure 6:
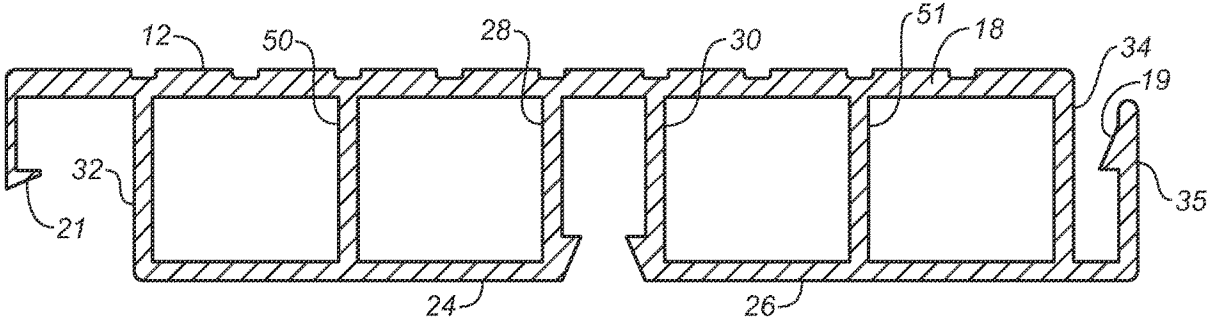
FIG. 6 is an end view showing alternative design for engagement.
Figure 6A:
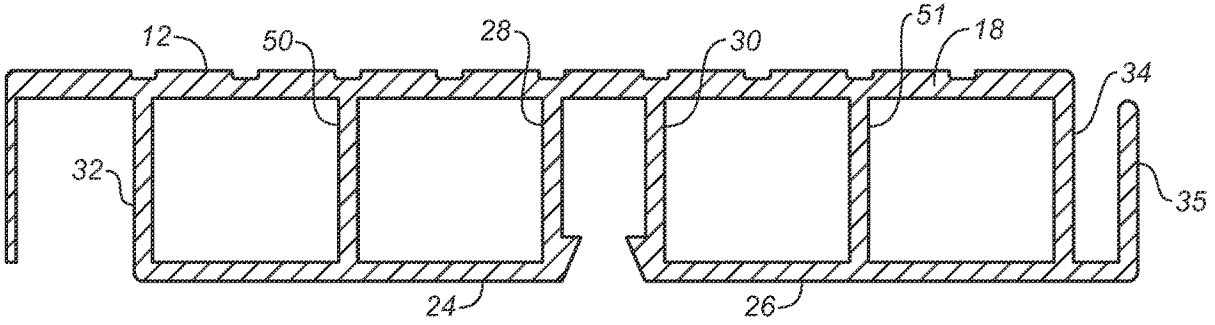
FIG. 6A is an end view of FIG. 1B.

FIG. 6 shows a slight alteration of inter-engagement flange 21. The flange is located inwardly and can be matched to mate with ledge 19. Horizontal-supporting member 18 has a top surface plank imprint or grooves 14 (FIG. 1A) which are integrally formed and or extruded on the top surface of the deck plank. A plurality of imprints of varying kind can be formed or embossed to serve as the walking surface of the deck plank. The embodiments of FIGS. 1B and 6A do not have ledge 19 or flange 21 but will still have water-resistant capability due to their configuration. Downward facing supporting leg 45 and outside supporting leg 35 add support to the upper walking surface of plank 12.

Planks—FIGS. 1A, 1B, 1C, 4, 5, and 6

Deck plank 12 (FIG. 4) has an upper supporting member or top surface 18 and attaches to bottom supporting members 24 and 26 by way of outside vertical supporting panels 32 and 34, and intermediate integral vertical supporting panels 28 and 30. The plank 12 is wider than it is tall and generally has one elongated recess 29 which extends along the length of the underside of the deck plank. In other embodiments, a plurality of elongated recesses or protrusions can be located at the underside or outsides of deck plank 12. In this first embodiment the recess is located generally in the middle portion of the underside of the deck plank. As shown, top surface 18 is continuous for substantially the entire width of the plank, including its portion above recess 29. Engaging ledges 42 and 44 (FIGS. 4 and 5) are located within the elongated recess and extend along the length of the deck plank.

Figure 4:
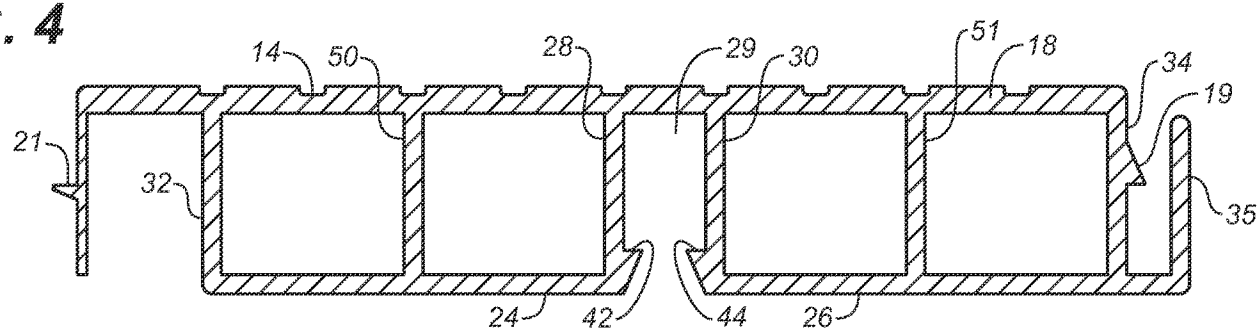
FIG. 4 is an end view of FIG. 1C.

The plank has intermediate integral vertical supporting panels or partitions 28 and 30 (FIG. 4). Intermediate vertical supporting panels 28 and 30 extend along the length of the plank and Intermediate vertical supporting panels 28 and 30 join upper horizontal supporting member 18 (FIGS. 1A, 1B, and 1C) to bottom horizontal supporting members 24 and 26. The plank also has intermediate supporting webs 50 and 51 which also extend along the length of the deck planks for added structural support. (FIGS. 1B and 1C) show downward facing supporting leg 45 which helps support the end portion of the deck plank.

Bottom horizontal-supporting members 24 and 26 form the base of the deck plank and are directly connected to outside vertical supporting panels or sections 32 and 34. Bottom horizontal-supporting member 26 runs past outside vertical supporting panel 34 and connects with outside supporting leg 35 (FIG. 4). Panel 34 has an inter-engagement ledge 19 integrally formed on its wall. FIG. 6 shows a slight alteration of inter engagement ledge 19 as it is relocated directly across and integrally formed with outside supporting leg 35. Ledge 19 is shaped and sized to mate with flange 21. Ledge 19 and flange 21 together will help keep foreign material from falling into the cavity below but are not necessary for a water-resistant result. The connection at ledge 19 and flange 21, together with the cohesive nature of water, will impede and limit water penetration to the cavity below.

Upper horizontal supporting member 18 extends laterally from outside vertical supporting panel 34 past outside vertically supporting panel 32 (FIG. 4) and terminates at a downwardly extending male inter-engagement flange 21. The approximate overall dimensions of the plank is 38 mm×152 mm but variations of size is limited only by the tooling and machines used to produce the plank.

Operation—FIGS. 2-5, 30-34

I believe that the manner of installing this deck plank and retaining clip to a substructure is superior to many or all planks in present use. To install a deck with the present components above a substructure of parallel joists, one first installs engaging clips 46 (FIGS. 2, 3, and 5) to a joist 49 with an attachment screw 48 in a top portion of each clip. A first clip is installed over and parallel to joist 49, as shown in FIG. 5. Succeeding clips are installed in the same manner so that each succeeding clip is parallel to and above the joist 49. First end 60 of one clip engages or fits integrally with second end 61 of the succeeding clip. The clips are installed over and in parallel with all joists over the area to be covered by deck planks. The clips can be made to abut one another, but this would reduce accuracy of installation, which can happen if, when attaching the clip, it wanders from the end of the adjoining clip. The installer installs enough clips and planks to cover the entire deck.

Next, the installer holds a deck plank directly centered over the pair of flanges 52 and 54 portion of clip 46 so that the elongated recess 29 (FIGS. 4 and 5) of the plank 12 aligns with the clip flanges. Then the installer applies a generally downward force to deck plank 12. This force is most easily accomplished by stepping on the plank so that the weight of the installer causes inwardly sloping surfaces in the slot under the plank to ride over flanges 52 and 54, whereby the deck plank engages and attaches to clip 46. Specifically, flange-retaining projections 52 and 54 of the clip will ride over the sloping surfaces and then engage the upper surfaces of ledges 42 and 44 (FIG. 5).

Boss 66 (FIGS. 30, 31, 32, and 33) can be used in places where clip 46 is hindered due to limited space or tough to reach areas during construction. Lower body 65 rests on the sub assembly or joist 49 and is spaced to coincide with the layout of clip 46. An attachment screw 48 will secure the boss when it passes through attachment hole 62 into joist 49. The deck plank with upper body 64 of boss 66 is secured in a similar manner to clip 46. A jig 70 (FIG. 34) can be used to align the bosses for consecutive spacing to aid in accuracy if necessary. The bosses are placed at boss slot 72 of jig 70 and the jig slots are spaced to allow a proper alignment of bosses which mat with deck planks.

Figure 8:
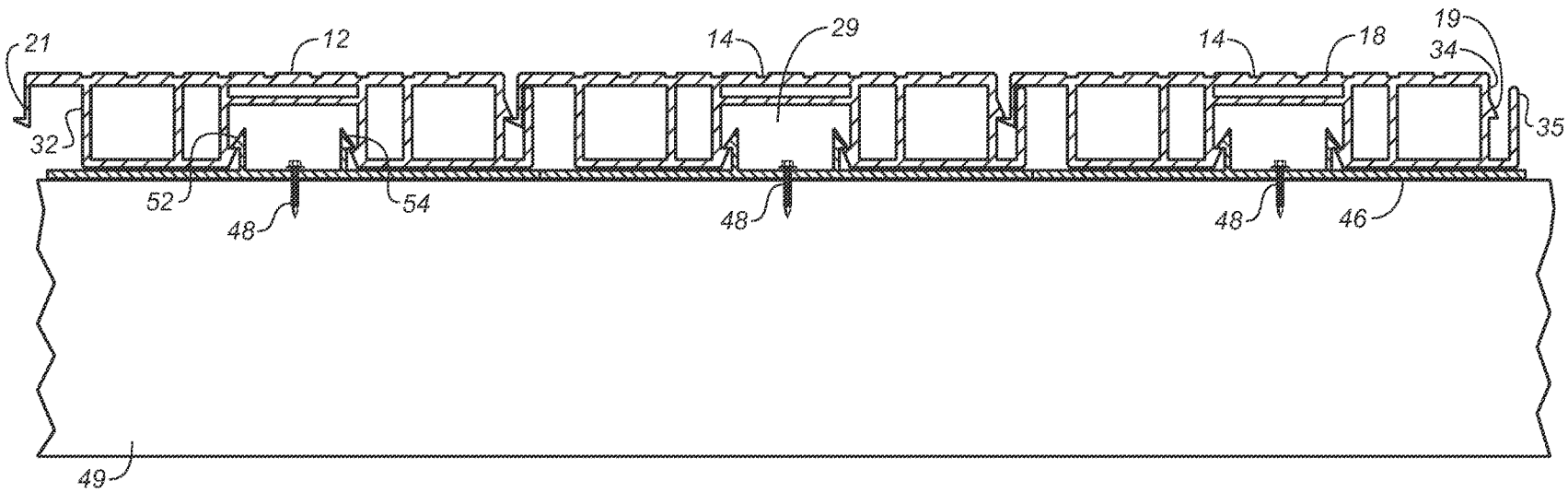
FIG. 8 is an end view of deck planks and engagement clips.

At the same time that the deck and clip are engaged, male inter-engagement flange 21 engages with female ledge 19 (FIGS. 5 and 8). Stepping downward on the deck forces male flange 21 to engage with female ledge 19. Outside support leg 35 supports the upper surface of the flange body of male inter engagement flange 21. This connection helps create a water-resistant top surface. However, if water were to penetrate the seam, the water would seep into a newly created cavity between outside vertical supporting panel 34 and outside supporting leg 35. Fasteners to secure the deck plank are not needed in the newly created cavity, and thus any seepage at the seam must run into the water resistant cavity and then travel to the outside ends of the deck plank leaving the area under the deck plank dry. The cavity portion is the main water resistant deterrent and does not rely on the secondary function of male inter engagement flange 21 and female ledge 19 for water resistant results.

To remove deck plank 12 from engagement clip 46; e.g., for remodeling or alteration or repairs, one inserts a slotted screwdriver under deck plank 12 into elongated recess 29 at one end of the deck plank near a joist 49. The screwdriver should have a greater width than the space between retaining flanges 52 and 54. The worker then turns the screwdriver 90°. This forces the engaging ledgers 42 and 44 outward and thereby separates the end of the deck plank from retaining flange projections 52 and 54, releasing the plank from the clip. This process is repeated at each clip and joist location to completely remove a deck plank 12. Male inter engagement flange 21 will also need to be released from female inter engagement ledge 19. This can be accomplished by inserting a slotted screwdriver at the seam of the deck planks 12 and prying horizontally to relieve male end 21 from female end 19. Once the first plank is removed the subsequent planks will not have to be pried at the plank seams. When the plank is released from the clip at the underside of the deck plank with a screwdriver, it is lifted slightly up and maneuvered so male inter engagement flange 21 will release its connection with female inter engagement ledge 19 smoothly.

If the ends of the deck planks are not accessible, e.g., due to their abutting a wall, access may be obtained by either crawling under the deck, if accessible for removal purposes, or ripping a plank or removing part of a plank so as to gain access to the underside of the deck structure, so the process of removal can take place.

FIGS. 6, 7, 9, 14, 20, 27—Additional Embodiments

Figure 7:
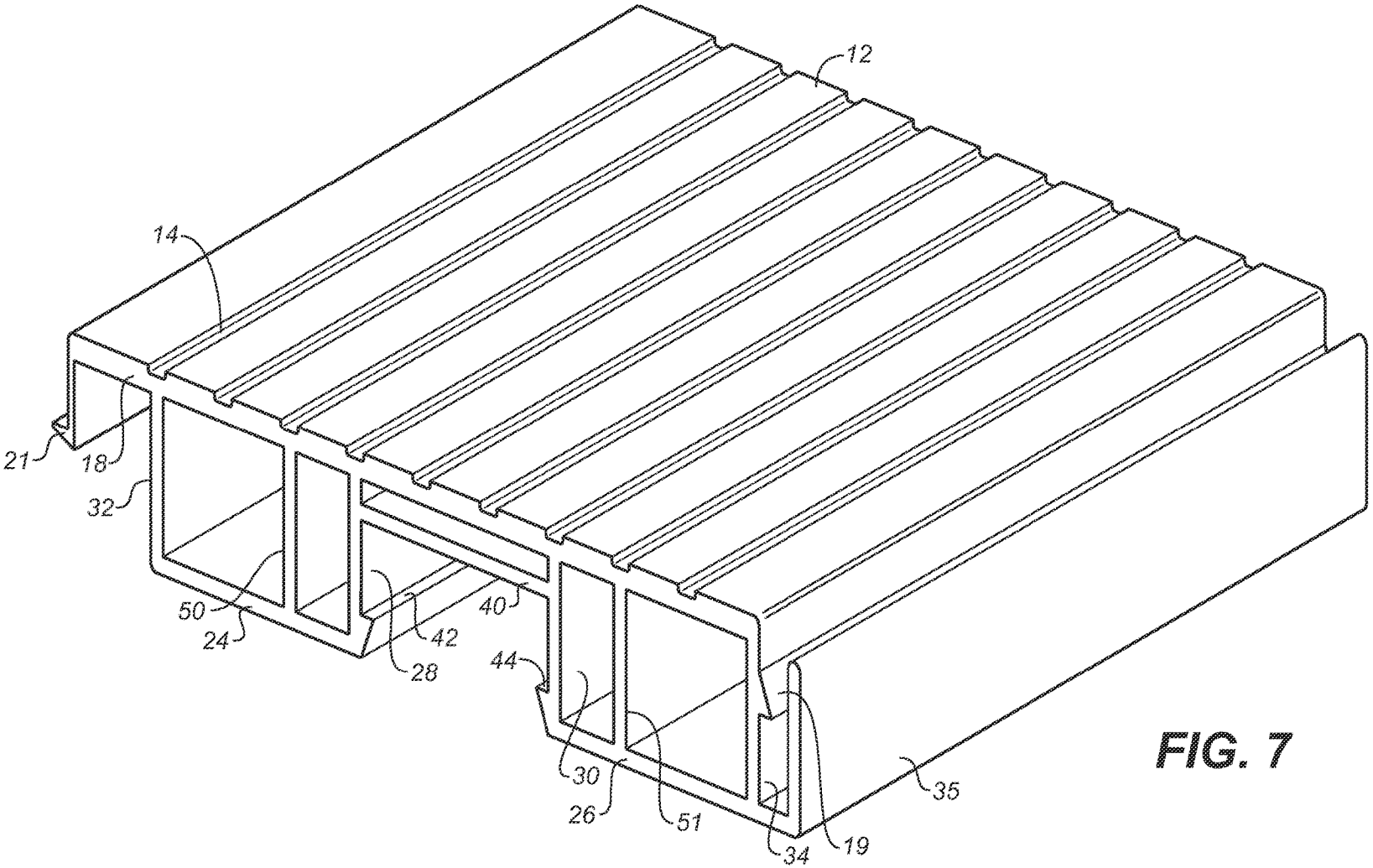
FIG. 7 is a partial perspective view of FIG. 1A.
Figure 12:
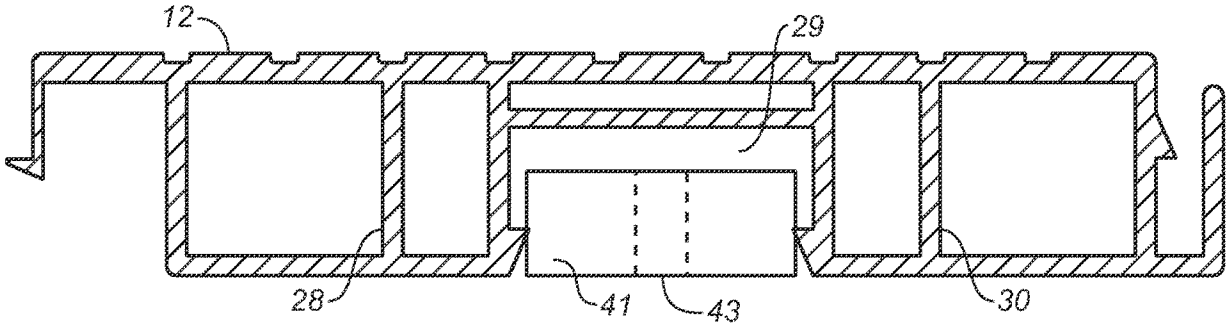
FIG. 12 is an end view of the deck plank and a removal tool.
Figure 13:
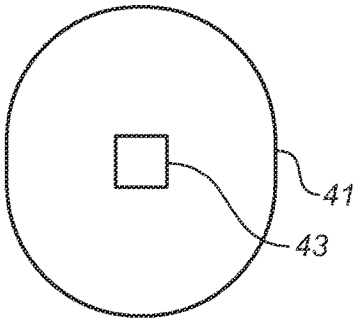
FIG. 13 is a top view of the removal tool.

FIG. 7 shows a partial perspective view of a second embodiment. Elongated recess # is wider than the first embodiment and thus must have a flange leg to support both retaining flange projection 52 and retaining flange projection 54, respectively. Elongated recess 29 is too wide for a screwdriver to be used to disconnect the deck plank from the clip. FIGS. 12 and 13 shows a tool 41 for removing deck plank 12 from clip 46 for remodeling or repairs. One inserts tool 41, which has a greater length than the space between retaining flanges 52 and 54, under deck plank 12 into elongated recess 29 at one end of the deck plank near joist 49. The worker then turns tool 41 ninety degrees using a standard socket wrench which fits into socket slot 43. This forces engaging ledgers 42 and 44 outward and thereby separates the end of the deck plank from retaining flange projections 52 and 54, releasing the plank from the clip. This process is similar to the deck plank removal of the first embodiment.

Figure 9:
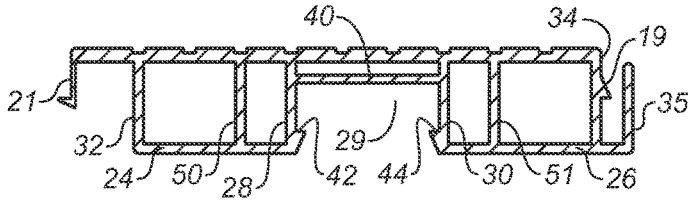
FIG. 9 is an end view of the deck plank shown in FIG. 8.
Figure 10:
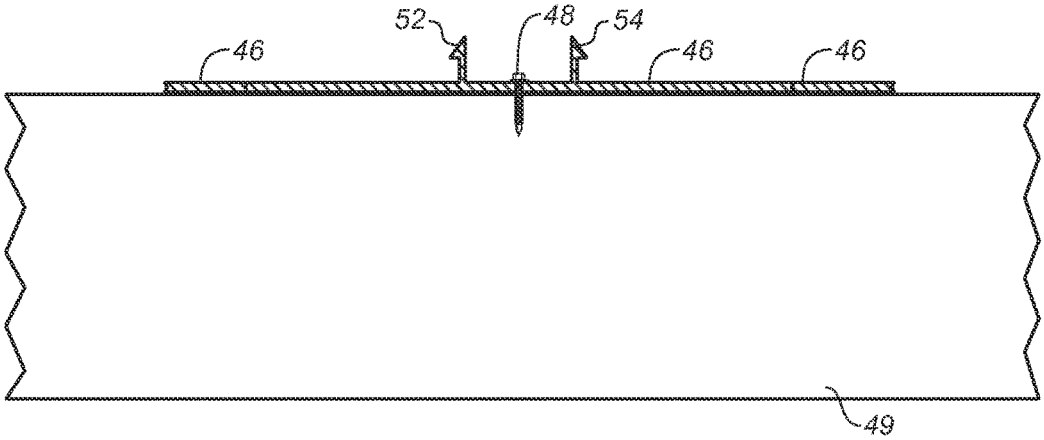
FIG. 10 is a side view of an engagement clip and attachment screw.

FIG. 10 shows the clip which is used with plank of FIG. 9. The deck planks intermediate integral vertical supporting panels or partitions 28 and 30 are joined by a horizontal stabilizing web 40 which decreases the spreading capability of the deck plank 12, helping it to remain firmly affixed to clip 46. Web 40 in this embodiment extends the length of the deck plank. Web 40 can be eliminated in the first embodiment to saving money but more importantly to allow a smoother, easier extrusion process during manufacturing.

Figure 1B:
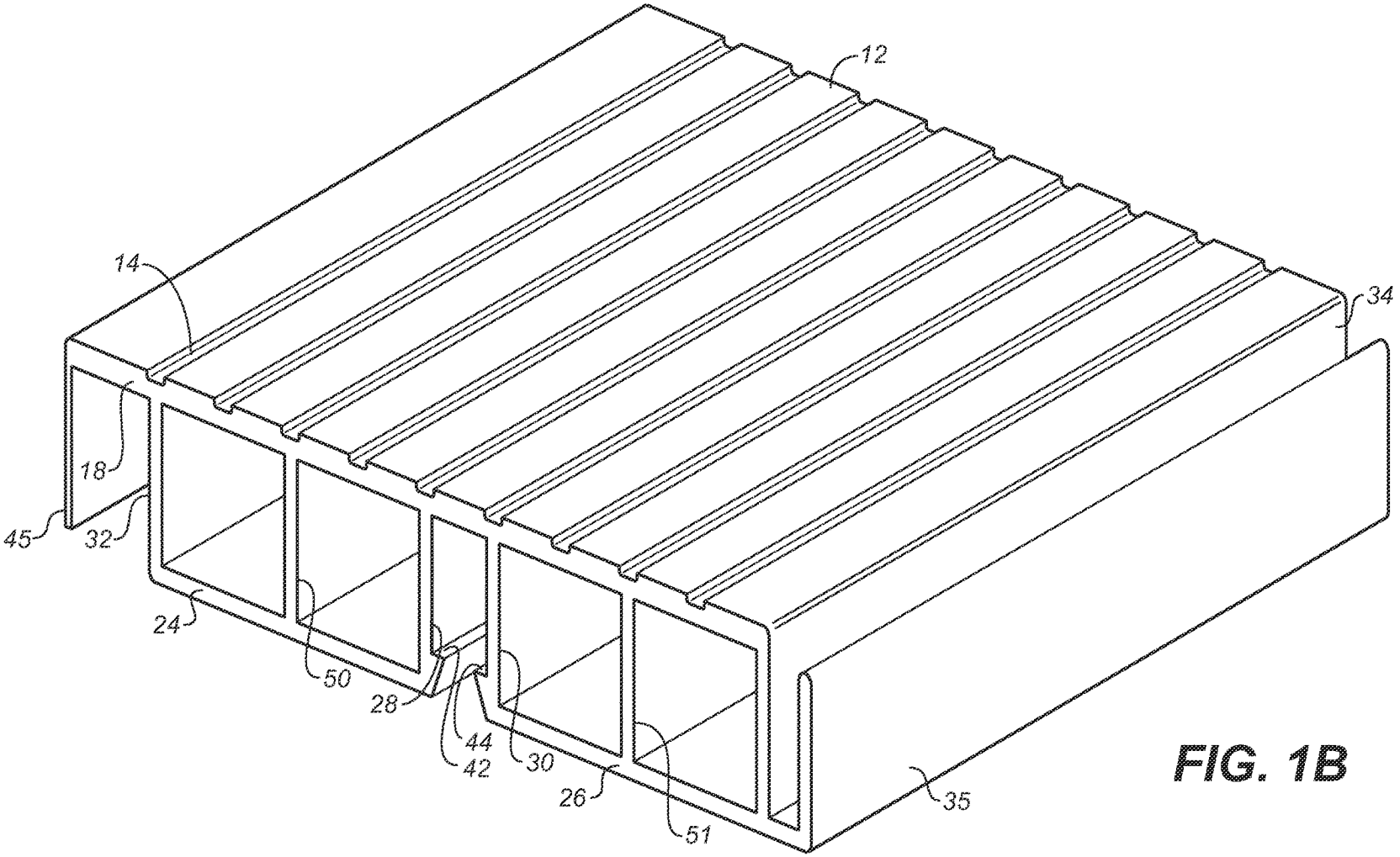
FIG. 1B is a partial perspective view of a deck plank.
Figure 1C:
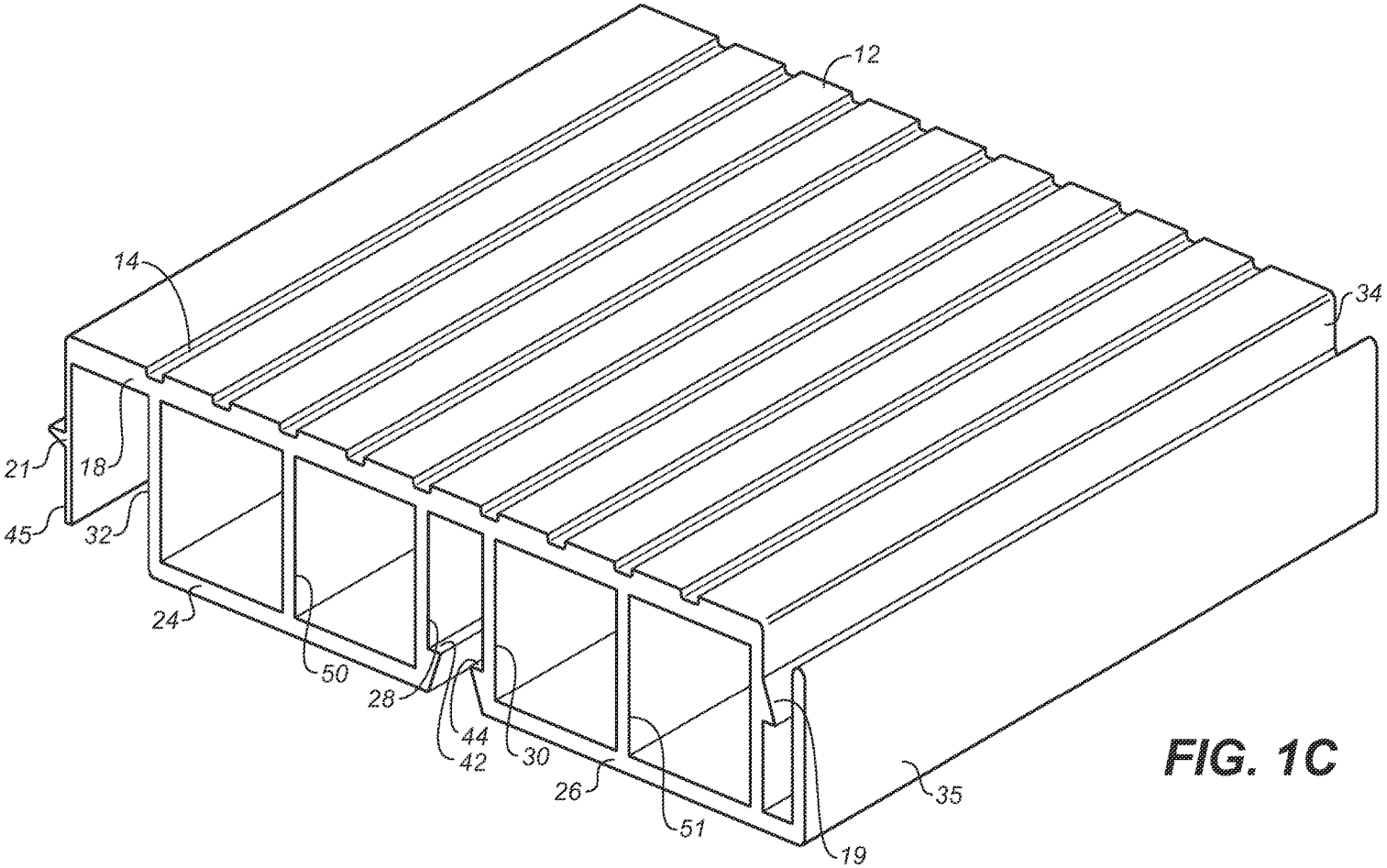
FIG. 1C is a partial perspective view of a deck plank.

FIGS. 8 and 9 show that the second embodiment is similar to the first embodiment of FIGS. 1A, 1B, and 1C, and operates in a similar manner. This clip and deck system can be used in other areas of construction like roof coverings, acoustical ceilings, walls, or fence structures and the like. The same principles of application apply to an overhead ceiling or vertical wall or fence other than the orientation of the material on the building structure.

Figure 11A:
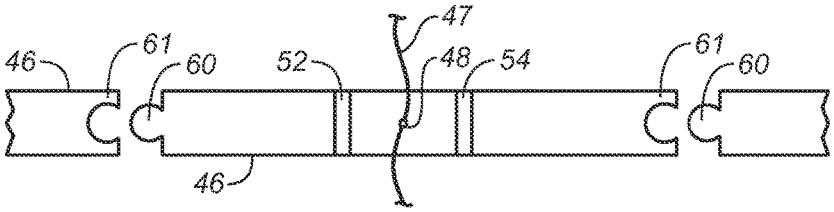
FIG. 11A is a top view of an engagement clip.
Figure 11B:
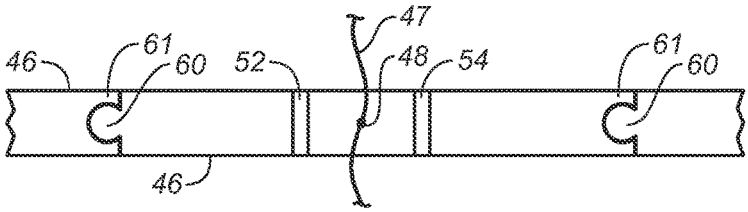
FIG. 11B is a top view of FIG. 11A.

FIGS. 11A and 11B shows a ground wire 47 which can be fastened at the same time that attachment screw 48 is fastened down on an aluminum clip 46. Wire 47 is connected at each joist. When using interconnecting clip ends as in FIGS. 22, 23, 24, 25, and 26, a contiguous relationship is created between the ends of clips so that the clips and ground wire 47 will ground the deck for relief of static electricity. Polypropylene as well as other plastics can also be blended and manufactured to increase electrical conductivity and thus an injection molded clip can be manufactured to allow a ground wire to be attached to reduce static electricity from the deck surface.

Figure 14:
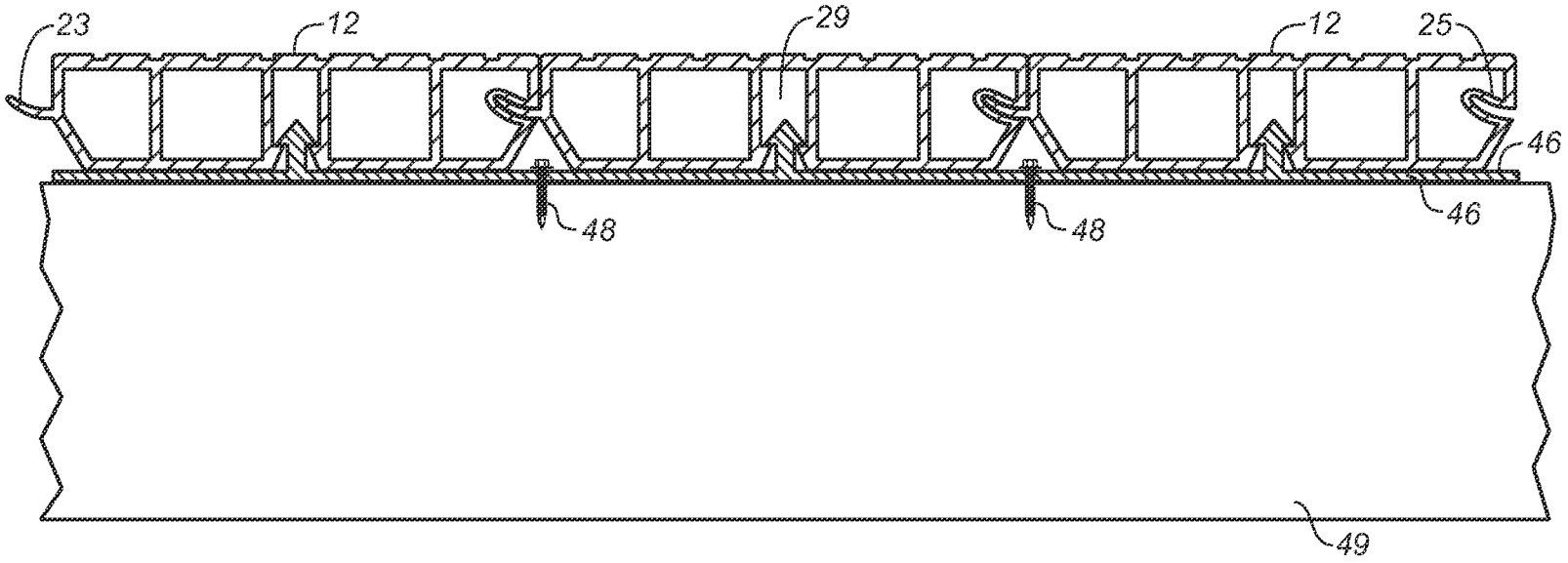
FIG. 14 is an end view of deck plank and engagement clip.

FIG. 14 is an end view of an alternative embodiment showing deck plank 12 with a different deck plank to deck plank connection than that of the deck plank of FIGS. 1A, 1B, and 1C. As shown in FIG. 14 male inter engagement rib 23 will mate with female channel 25 when inserted. This male female connection will provide a water-resistant seam between adjacent deck planks.

Figure 15:
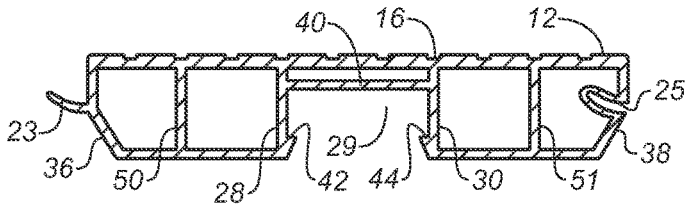
FIG. 15 is an end view of the deck plank.

FIG. 15 shows an end view of the alternative embodiment of FIG. 14. Oblique supporting panels 36 and 38 create a space or a void at the seams of adjacent deck planks at the lower portion of the clip. This space can be used if, for instance, the clips are manufactured as in FIGS. 22 and 24. A raised portion of the clip results at the clip ends. FIG. 23 is an enlarged partial view of FIG. 22 showing a lap over and engagement connection between a plurality of clip assemblies. First end 56 is covered and connected with second end 57. This connection is simple, yet allows easy removal if applicable. The space or void created by oblique supporting panels 36 and 38 allow room for the clips to have a raised area for alternative clip connections as observed by the drawings.

FIG. 24 is an isometric view of an alternative clip embodiment showing a dovetail engagement between a plurality of clip assembly ends. FIG. 25 is an enlarged partial view of FIG. 24. First end 58 is interconnected with second end 59 by sliding the ends together. This connection is very stable but requires more work if clips need to be removed or repaired. Again the clip will be raised at the clip ends as earlier stated so a void is needed between deck plank seams as discussed with this style clip in order to work.

FIG. 26 is an isometric view of an alternative embodiment of clip ends. First end 60 mates with second end 61 like a puzzle connection. This allows the clip to remain flat so a void is not needed at plank seams. Many variations of clip connections can be made and produce adequate or like results.

Figure 16:
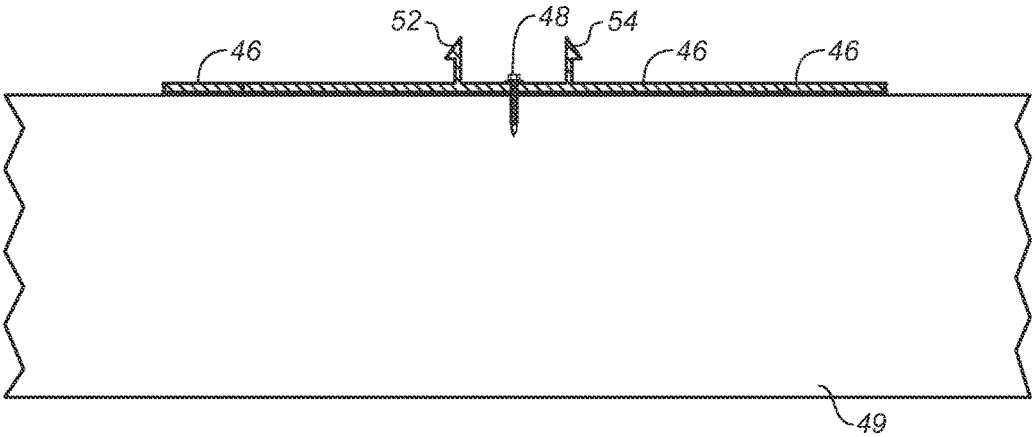
FIG. 16 is a side view of the engagement clip and attachment screw of FIG. 15.

FIG. 16 is a side view of the engagement clip and attachment screw of FIG. 9 that holds the clip in place.

Figure 17A:
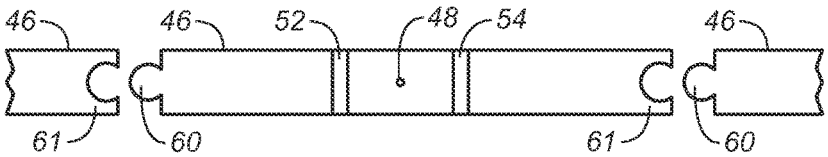
FIG. 17A is a top view of the engagement clip of FIG. 15.
Figure 17B:
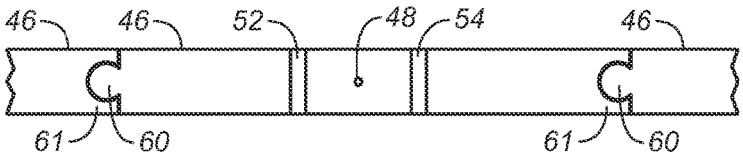
FIG. 17B is a top view of FIG. 17A showing a plurality of mating ends engaging.

FIGS. 17A and 17B are top views of the engagement clip of FIG. 15 with lines indicating retaining flange projections of the clip and mating ends for engaging clip to clip.

Figure 18:
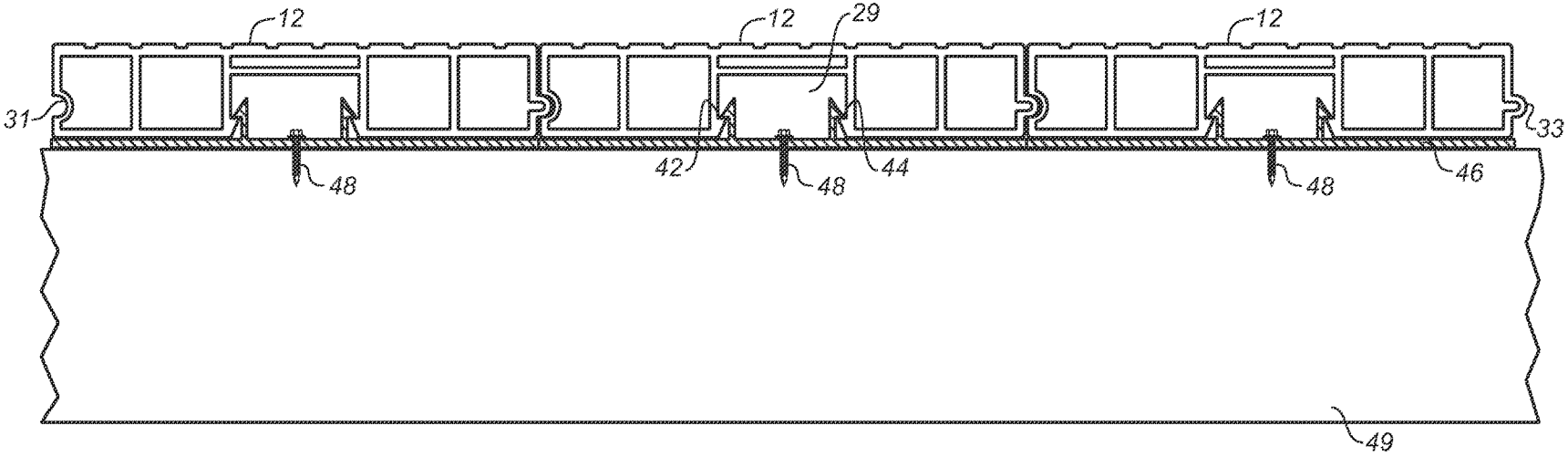
FIG. 18 is an end view of an alternative embodiment.
Figure 20:
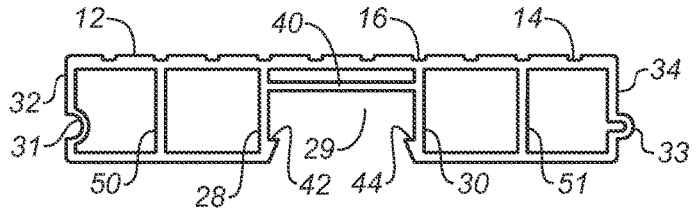
FIG. 20 is an end view of a deck plank shown in FIG. 18.
Figure 19:
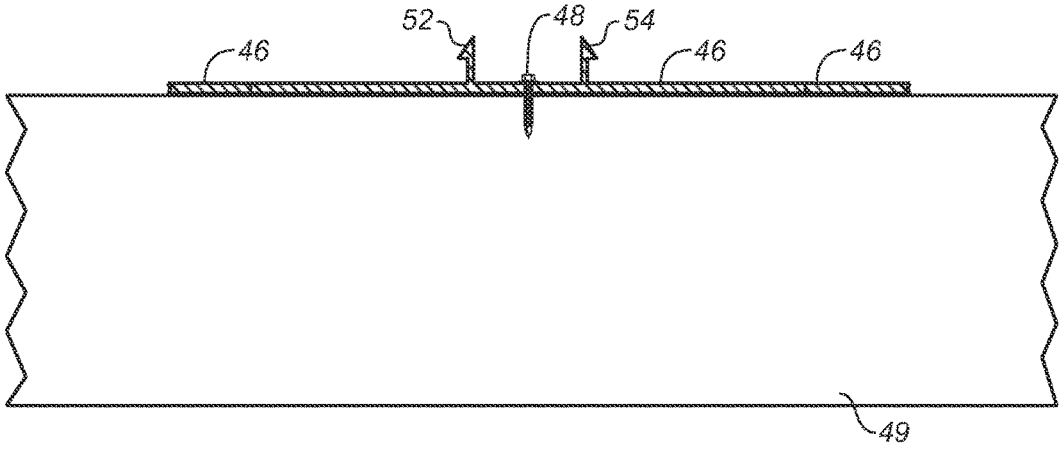
FIG. 19 is a side view of the engagement clip and attachment screw of FIG. 18.
Figure 21A:
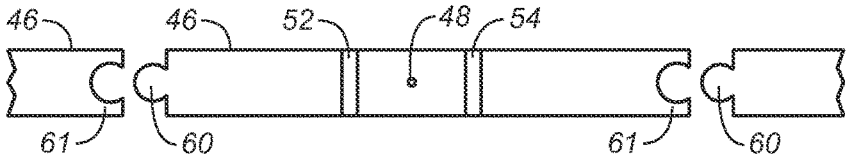
FIG. 21A is a top view of the engagement clip of FIG. 19.
Figure 21B:
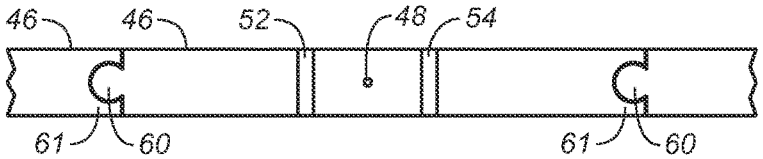
FIG. 21B is a top view of FIG. 21A showing a plurality of clip mating ends engaged.

FIG. 18 is an end view of an alternative embodiment showing a plurality of deck planks engaged to engagement clips that in turn is secured to a horizontal member. A female elongated slot 31 is shown integrally formed on panel 32 to mate with male elongated projection 33 located on outside vertical supporting panel 34. A water-resistant seal will exist when male projection 33 mates with female elongated slot 31.

FIGS. 19, 20, 21A, and 21B show the side view, end view, and top view of the alternative embodiment of FIG. 18. The clip system is generally the same as previously described.

FIG. 27 is an end view of an alternative embodiment of a deck plank, illustrating the fitting means for both the water-resistant upper portion of the deck plank and the water-resistant cavity of the lower portion. An elongated channel or groove 37 is integrally formed at the side portion of outside vertical support panel 32. An elongated channel or groove 39 is integrally formed at the generally lower portion of outside supporting leg 35. Channel 39 will provide better holding ability lower down on supporting leg 35 as shown. Elongated channels 37 and 39 can be configured in a variety of shapes on plank 12 and will combine with the flanges of a mating clip to which plank 12 can be attached.

For example, the channel can be a rectangular rather than a concave shape as shown in FIG. 27 and will mate with a flange to engage such a rectangular channel. Also, instead of a channel, a protrusion can be easily designed to mate with a clip of both areas of elongated channels 37 and 39. These variations will allow for a pair of flanges of a clip to face each other for a clipping engagement, or face the same direction for a clipping engagement.

Figure 29A:
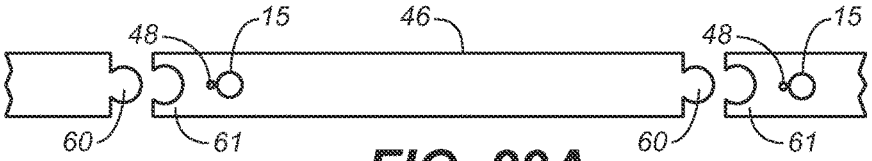
FIG. 29A is a top view of the engagement clip of FIG. 28.
Figure 29B:
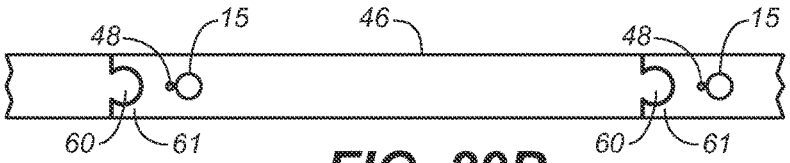
FIG. 29B is a top view of FIG. 29A.

Two flanges extend in opposite directions from flange support leg 55 as viewed in FIG. 2, or a symmetrical flange 15 can be used on each leg (FIG. 28). In either case, as shown, the flange is substantially parallel to the top surface of clip 46 and extends out from the leg in a plurality of directions. As also shown, each flange has a bottom surface which faces and is parallel to the top surface of clip 46 and an anticline top surface that tapers up from the outer edge of the top surface toward the axis of the leg, or an extension of the axis above the leg so that the flanges can mate with a deck plank 12 (FIG. 1B or FIG. 27). FIGS. 29A and 29B are top views of the engagement clip of FIG. 28 with circular lines indicating flange projections for engaging the deck plank. Outside supporting leg 35, shown in FIG. 27, will bend in slightly so that its channels or grooves 39 will engage with one side of each of symmetrical flanges 15 of clip 46 of FIG. 28 when a generally downward force is applied.

Symmetrical flange 15 (FIGS. 28, 29A, and 29B) can also be used with the embodiments of FIGS. 1, 6, 7, 8, 9, 14, and 18. The uppermost portion of flange 15 is a single flange which overhangs the lower portion at a distance which will secure with engaging ledges 42 and 44 of the deck. A clip 46 can be made by injection molding using plastic. The plastic clip having a plastic symmetrical flange 15 will allow the flange to bend slightly and engage with a deck plank 12 for a secure engagement. A polypropylene material can be used for the injected molded clip. The polypropylene clip will not squeak when engaged with a deck plank 12 made of polyvinyl chloride (PVC) due to their differing materials. However, other materials for both deck plank 12 and clip 46 can be used, such as aluminum, composite, or other metals.

Clips 46 can be extruded from aluminum and cut into individual parts to be used. The aluminum clip with engagement ends can be grounded by a simple ground wire which would connect each individual row of clips from joist to joist. By connecting the clips with a ground wire the deck would be more resistant to static electricity which could be useful at refueling areas like a marine gas station.

An injection molded clip can be manufactured inexpensively and the injection molding process allows very exacting dimensions and tolerances, useful to insure cooperation when engaging with a deck plank 12. The alternative embodiment of deck plank 12 (FIG. 27) can be removed by urging outside supporting leg 35 towards outside vertical supporting panel 34, which will disengage the symmetrical flange 15 from the deck plank 12. A standard small pry bar can be used alongside the joist, preferably from the underside of the deck at the seam of two deck planks. The deck planks can be removed in this manner and can also be re-engaged with the clips after a repair, alteration, or addition has been completed. This dual-fitting plank and clip system allows an easy engagement of plank and clip while providing a water-resistant surface. The clipping system allows for expansion and contraction of the building parts. The screw that holds down the clip can be a standard screw which is tapered at the head and which will mate with the clip hole. The hole can also be tapered to receive the screw. The result would be that the screw head would be flush with the clip.

FIGS. 30 and 31 show a round-flanged boss 66 which can be used in conjunction with clip 46 for securing a deck to its substructure. Boss 66 can also be manufactured with a rectangular or square flange as shown in FIGS. 32 and 33. The flange of both of these shapes has a bottom surface that is continuous about the leg of the boss and that will engage the deck plank for securement. It is recommended that these bosses be used in tough-to-reach or oblique angles of a deck (45° angles) where a regular clip 46 is not readily installable. These bosses can be used in place of a clip to secure an entire deck down to a sub structure. This can be more accurately done by using a jig such as jig or template 70 (FIG. 34). Jig 70 has notches 72 located accurately to space the bosses to receive the deck planks uniformly.

Wood and composite decks sometimes use a biscuit system (well known in the art) for attachment of planks to a surface. A biscuit generally is a thin, oval-shaped wafer that connects two parallel planks at grooves in the sides of the planks. The biscuit is placed in the groove of a first plank that is secured to a subassembly, and a second plank is laid down beside the first plank. Force is applied towards the first plank using a mallet. Generally there is a gap between the first plank and the second plank. The biscuit which is placed between the first plank and second plank and over the joist is screwed down to attach the biscuit to the joist between the gap. The biscuit system does not provide predetermined accuracy in layout and thus installation errors are present.

The flexibility of using a system with bosses 66 (FIGS. 30, 31, 32, and 33) can also be realized with deck orientations other than those perpendicular to the joist. For example, when a six-inch center-to-center spacing is needed for decking planks perpendicular to joists and the architect desires deck planks to be at 45° angles in relations to the joists. The spacing center-to-center would need to be increased to 8.5 inches. Individual boss 66 would allow this change without undue hardship. Thus the dual fitting plank system can be flexible to many project situations.

FIG. 35 shows an alternative embodiment which eliminates the water-resistant portion of the deck plank. This embodiment has the same attachment means as elongated recess 29 (FIG. 5) but eliminates the water-resistant cavity of other embodiments. Some projects require a gap at the edge of planks to allow water to pass at the gap location. This embodiment allows this situation if desired while still providing the simple single flange leg and at least one flange which overhangs or is continuous about the upper portion of the flange leg.

CONCLUSION, RAMIFICATIONS AND SCOPE

Accordingly the reader will see that my deck plank extrusion and retaining clip can be used readily in deck and dock applications as well as other uses. It can be removed easily when necessary without damaging the clip or plank. Furthermore, the deck plank and clip have additional advantages.

This deck plank and clip system permits the top surface of the deck plank to be free of unsightly fasteners that detract from the aesthetic look of the top deck surface, while providing a water resistant capability at said top deck surface. It also provides a deck that is easily assembled, even by those unskilled in the art. It does not require fasteners to directly penetrate the deck planks themselves, thus protecting the water resistant envelope provided by the plank and clip system.

While the above description contains many specificities, these should not be construed as limitations on the scope, but rather as an exemplification of one (or several) embodiments thereof. Many other variations are possible. For example, the deck plank can have multiple elongated channels and/or protrusions on its underside with cooperating configurations or means that could mate with appropriate clips. A plurality of channels and/or protrusions can be extruded on the side portions which can be configured to mate with appropriate clips to secure a planking system. A variation of channels and/or protrusions on side portions and underside of plank can be configured to mate with a clip for attachment.

Accordingly, the scope should be determined by the appended claims and their legal equivalents and not by the embodiments illustrated.

The invention claimed is:

1. A clip and mating deck plank for attaching said deck plank to a surface, comprising:

a deck plank having a bottom recess with at least a pair of ledges in said recess and a continuous top surface above said recess, a clip having a flat bottom portion which can be attached to said surface, said bottom portion having a length defined by a pair of opposite ends, at least one flange-support leg extending up from said bottom portion, said flange-support leg having an axis, a flange extending out from an upper portion of said flange-support leg so that said flange is spaced up from said flat bottom portion, said flange being substantially parallel to said flat bottom portion, extending out from said flange-support leg in at least a plurality of directions, and being symmetrical with respect to said flange-support leg, said flange having a bottom surface that is continuous about said flange-support leg and that faces and is substantially parallel to said bottom portion, said bottom surface of said flange having an outer edge that is spaced from said flange-support leg, said flange-support leg being securely affixed to said flat bottom portion so that said flange and said flange-support leg cannot rotate, said flange having an anticline top surface that tapers up from said outer edge toward said axis of said flange support leg or an extension of said axis above said flange-support leg, whereby when said flange support leg is inserted into said recess in said bottom of said deck plank, said bottom portion of said flange can interlock with said pair of ledges in said recess to hold said deck plank firmly and securely to said surface.

2. The clip and mating deck plank of claim 1 in combination with a template, further including at least one additional clip similar to said first named clip, said clips spaced from each other on said surface by a predetermined spacing, and further including a template with said predetermined spacing indicated thereon for enabling said flange-support legs of said clips to be placed so that they will be accurately oriented with a plurality of recesses in said bottom of said deck plank.

3. The clip and mating deck plank of claim 1 wherein said bottom surface of said flange is continuous about said flange-support leg and said top surface is continuous about said axis of said flange-support leg.

4. The clip and mating deck plank of claim 3 wherein said top surface of said flange has a shape, when seen from above, selected from the group consisting of rectangular and round.

5. The clip and mating deck plank of claim 1, further including an additional clip similar to said first-named clip, each of said clips having an engagement part at at least one end of said flat bottom portion of said clip so that said engagement part can engage part of the opposite end of an adjoining clip.

6. The clip and mating deck plank of claim 1 wherein:

said deck plank has an upper surface and an underside, and first and second sidewalls connecting said upper surface with said underside, said upper surface extends laterally beyond said first sidewall and having a downwardly extending longitudinal leg formed thereon, said underside extends laterally beyond said second sidewall and having an upwardly extending longitudinal wall formed thereon to define an upwardly open channel adjacent said second sidewall and adapted to receive therein said downwardly extending longitudinal leg of an adjacent deck plank in water-resistant relation said underside is substantially parallel to said upper surface and having an elongated recess in a portion of said bottom surface, said elongated recess extends along the length of said deck plank, said elongated recess has a pair of sidewalls which directly face each other and which are spaced apart by a predetermined spacing, said pair of sidewalls has a pair of respective ledges for engaging and mating with said flange of said clip.

7. A clip and mating deck plank for attaching said deck plank to a surface, comprising:

a deck plank having a bottom recess with at least a pair of ledges in said recess and a continuous top surface above said recess, said clip comprising an elongated strip having bottom and top opposing surfaces separated by a predetermined thickness, a width that is greater than said thickness, and a length that is defined by a pair of opposite ends and that is greater than said width, a flange-support leg extending up from said top surface of said strip between said opposite ends, said flange-support leg having an axis, said leg having a flange projecting out from said leg at a location on said leg spaced up from said top surface of said clip, said flange being substantially parallel to said flat bottom portion, extending out from said flange-support leg in at least a plurality of directions, and being symmetrical with respect to said flange-support leg, said flange having an underside which is continuous about said flange-support leg and that faces and is parallel to said top surface for engaging and mating with said pair of ledges inside said recess of said deck plank, said flange-support leg being securely affixed to said elongated strip so that said flange and said flange-support leg cannot rotate, said flange having a top surface that tapers up from said outer edge toward said axis of said flange support leg or an extension of said axis above said flange-support leg, whereby when said flange support leg is inserted into said recess in said bottom of said deck plank, said bottom portion of said flange can interlock with said pair of ledges in said recess to hold said deck plank firmly and securely to said surface.

8. The clip and mating deck plank of claim 7 wherein said flange has an anticline sloping upper surface, said upper surface sloping upwardly from said underside toward said axis of said flange support leg, or an extension of said axis above said flange-support leg, so as to form an anticline sloping upper surface that can be inserted past a ledge of a deck plank so that said flange can be forced past said ledge.

9. The clip and mating deck plank of claim 7, further including an elongated deck plank, said deck plank having an upper surface and an underside, and first and second sidewalls connecting said upper surface with said underside, said upper surface extending laterally beyond said first sidewall and having a downwardly extending longitudinal leg formed thereon, said underside extending laterally beyond said second sidewall and having an upwardly extending longitudinal wall formed thereon to define an upwardly open channel adjacent said second sidewall and adapted to receive therein said downwardly extending longitudinal leg of an adjacent deck plank in water-resistant relation said underside having a bottom surface which is substantially parallel to said upper surface and an elongated recess in a portion of said bottom surface, said elongated recess extending along the length of said deck plank, said elongated recess having a pair of sidewalls which directly face each other and which are spaced apart by a predetermined spacing, said elongated recess having means therein for engaging and mating with said at least one flange of said clip.

10. The clip and mating deck plank of claim 9 wherein said means for engaging and mating with said at least one flange comprises a bottom portion of at least one of said pair of sidewalls of said elongated recess that tapers up and inward toward the opposite sidewall to a ledge which faces upward so that said at least one sidewall contains an upwardly facing ledge, said ledge extending inward from and spaced up from the bottom of a respective sidewall by a predetermined distance, said ledge extending into said recess from said sidewall, whereby said deck plank can be connected smoothly and securely to said clip while maintaining a uniform alignment of said elongated deck planks over said surface, yet can be readily disconnected for maintenance or repair.

11. The clip and mating deck plank of claim 10, further comprising at least one internal wall extending between said upper surface and said underside of said clip.

12. The clip and mating deck plank of claim 11 wherein said downwardly extending longitudinal leg has formed thereon a flange which mates with a ledge formed on said upwardly open channel of an adjacent plank.

13. The clip and mating deck plank of claim 7 wherein said flange on said flange-support leg has two portions which project out from said leg in two opposite directions.

14. The clip and mating deck plank of claim 7 wherein said top surface of said strip has another flange support leg, similar to said first-named flange support leg, that is spaced from said first-named flange-support leg, said other flange-support leg having a flange thereon similar to said flange on said first-named flange-support leg so that flanges on said legs can be mated with an overlying deck plank.

15. The clip and mating deck plank of claim 14 wherein said bottom surface of each of said flanges is continuous about said flange-support leg and said top surface is continuous about said axis of said flange-support leg.

16. The clip and mating deck plank of claim 15 wherein said deck plank has an upper horizontal surface and a lower horizontal surface and two vertical walls perpendicular to said upper and lower surfaces, each of said vertical walls having a channel or groove therein that is spaced to mate with said respective flanges of said flange-support legs when said deck plank is pushed down onto said elongated strip.

17. The clip and mating deck plank of claim 15 wherein said top surface of said flange has a shape, when seen from above, selected from the group consisting of rectangular and round.

18. A clip and mating deck plank for attaching said deck plank to a surface, comprising:

a deck plank having a bottom recess with at least a pair of ledges in said recess and a continuous top surface above said recess, a clip having a flat bottom portion which can be attached to said surface, said bottom portion having a length defined by a pair of opposite ends, at least one flange-support leg extending up from said bottom portion, said flange-support leg having an axis, a flange extending out from an upper portion of said flange-support leg so that said flange is spaced up from said flat bottom portion and is substantially parallel to said flat bottom portion, said flange having a bottom surface that extends out from said flange-support leg and that faces and is substantially parallel to said bottom portion, said bottom surface having an outer edge that is spaced from said flange-support leg, said bottom surface of said flange being continuous about said flange-support leg, said flange having an anticline top surface that is continuous about said axis of said flange-support leg and that tapers up from said outer edge toward said axis of said flange support leg or an extension of said axis above said flange-support leg, said top surface of said flange having a shape, when seen from above, selected from the group consisting of rectangular and round, said flange being symmetrical with respect to said flange-support leg, said flange-support leg being securely affixed to said flat bottom portion of said clip so that said flange and said flange-support leg cannot rotate, whereby when said flange support leg is inserted into said recess in said bottom of said deck plank, said bottom portion of said flange can interlock with said pair of ledges in said recess to hold said deck plank firmly and securely to said surface.

* * * * *